US008344835B1

(12) United States Patent
Ko et al.

(10) Patent No.: US 8,344,835 B1
(45) Date of Patent: Jan. 1, 2013

(54) METHOD OF WINDING SUPERCONDUCTING WIRE AND MAGNET FABRICATED USING THE METHOD

(75) Inventors: Tae Kuk Ko, Seoul (KR); Jae Sik Kang, Seoul (KR); Hyun Chul Jo, Seoul (KR); Suk Jin Choi, Seoul (KR); Jin Bae Na, Seoul (KR); Jae Young Jang, Incheon (KR); Young Jin Hwang, Incheon (KR); Hyung Jun Kim, Jeonbuk (KR)

(73) Assignee: Industry-Academic Cooperation Foundation, Yonsel University, Seoul (KR)

( * ) Notice: Subject to any disclaimer, the term of this patent is extended or adjusted under 35 U.S.C. 154(b) by 0 days.

(21) Appl. No.: 13/436,104

(22) Filed: Mar. 30, 2012

(30) Foreign Application Priority Data

Mar. 26, 2012 (KR) ..... 10-2012-0030739

(51) Int. Cl.
*H01F 6/00* (2006.01)

(52) U.S. Cl. ..... 335/216; 505/211; 505/430; 505/433; 505/705; 505/879; 29/599

(58) Field of Classification Search ..... 335/216; 336/DIG. 1; 505/211, 430, 433, 705, 879, 505/880; 29/599
See application file for complete search history.

(56) References Cited

U.S. PATENT DOCUMENTS 7,301,425 B2 * 11/2007 Ko et al. ..... 335/216
8,035,933 B2 * 10/2011 Lee et al. ..... 361/19
8,178,473 B2 * 5/2012 Hong et al. ..... 505/430

FOREIGN PATENT DOCUMENTS

JP 11-135319 A 5/1999
KR 10-2007-0005834 A 1/2007

* cited by examiner

*Primary Examiner* — Ramon Barrera
(74) *Attorney, Agent, or Firm* — Holland & Knight LLP; Brian J. Colandreo, Esq.; Mark H. Whittenberger, Esq.

(57) ABSTRACT

The method of winding superconducting wire comprises a winding method comprising: winding the superconducting wire from the source reel onto the first lane of the first bobbin a first number of times in a first direction; fixing the first bobbin and the second bobbin to each other; winding the superconducting wire from the source reel onto the third lane of the second bobbin a second number of times in the first direction; separating the first bobbin and the second bobbin from each other; and winding the superconducting wire from the first lane of the first bobbin onto the fourth lane of the second bobbin a third number of times in a second direction which is different from the first direction while winding the superconducting wire from the third lane of the second bobbin onto the source reel the third number of times in the second direction.

18 Claims, 11 Drawing Sheets

METHOD OF WINDING SUPERCONDUCTING WIRE AND MAGNET FABRICATED USING THE METHOD

CROSS REFERENCE TO RELATED APPLICATION

This application claims priority from Korean Patent Application No. 10-2012-0030739 filed on Mar. 26, 2012 in the Korean Intellectual Property Office, the disclosure of which is incorporated herein by reference in its entirety.

BACKGROUND OF THE INVENTIVE CONCEPT

1. Field of the Inventive Concept

The present inventive concept relates to a method of winding a superconducting wire and a magnet fabricated using the method.

2. Description of the Related Art

A superconductor has no resistance (zero resistance) under predetermined conditions of temperature, intensity of a magnetic field, and current intensity. However, the superconductor has high resistance when not under the predetermined conditions.

Due to these characteristics, if a superconductor is connected in series to a power system, it can prevent the current that is generated when the power system suddenly breaks down. That is, the superconductor has high resistance when the fault current generated by the power system exceeds the critical current of the superconductor. Accordingly, the high resistance of the superconductor can prevent the flow of the fault current.

The superconductor is often used in the form of a wire since the wire can be manufactured and purchased easily and its size can be adjusted easily.

Meanwhile, a double pancake winding method is being widely used. The double pancake winding method is advantageous to wires in the form of thin tapes. A number of double pancake bobbins can be bonded together to manufacture a magnet. Here, some double pancake bobbins which are damaged by heat or mechanical disturbance can be replaced. However, a superconductor wound around each double pancake bobbin definitely has bonded parts. These bonded parts may become unnecessary resistance components, and heat generated by the resistance components may cause an unwanted loss of refrigerants.

SUMMARY OF THE INVENTIVE CONCEPT

Aspects of the present inventive concept provide a method of winding a superconducting wire, in which bonded parts of the superconducting wire can be minimized.

Aspects of the present inventive concept also provide a magnet which includes a superconducting wire having minimized bonded parts.

However, aspects of the present inventive concept are not restricted to the one set forth herein. The above and other aspects of the present inventive concept will become more apparent to one of ordinary skill in the art to which the present inventive concept pertains by referencing the detailed description of the present inventive concept given below.

According to an aspect of the present inventive concept, there is provided a winding method comprising, providing a source reel which has a superconducting wire wound thereabout, a first bobbin which comprises a first lane and a second lane, and a second bobbin which comprises a third lane and a fourth lane; winding the superconducting wire from the source reel onto the first lane of the first bobbin a first number of times in a first direction; fixing the first bobbin and the second bobbin to each other; winding the superconducting wire from the source reel onto the third lane of the second bobbin a second number of times in the first direction; separating the first bobbin and the second bobbin from each other; and winding the superconducting wire from the first lane of the first bobbin onto the fourth lane of the second bobbin a third number of times in a second direction which is different from the first direction while winding the superconducting wire from the third lane of the second bobbin onto the source reel the third number of times in the second direction.

According to another aspect of the present inventive concept, there is provided A winding method comprising: providing a source reel, a first bobbin which comprises a first lane and a second lane, and a second bobbin which comprises a third lane and a fourth lane; winding a superconducting wire around the first lane a second number of times in a first direction, around the second lane a first number of times in a second direction, and around the third lane the second number of times in the first direction; and winding the superconducting wire from the first lane of the first bobbin onto the fourth lane of the second bobbin the first number of times in the second direction while winding the superconducting wire from the third lane of the second bobbin onto the source reel the first number of times in the second direction, wherein the first direction and the second direction are different, and the superconducting wire is continuous.

According to still another aspect of the present inventive concept, there is provided a magnet comprising: a first bobbin comprising a first lane and a second lane; a second bobbin comprising a third lane and a fourth lane and fixed to the first bobbin to contact the first bobbin; and a superconducting wire wound around the first through fourth lanes, wherein the superconducting wire is continuous, wound around the first lane and the third lane in a first direction and wound around the second lane and the fourth lane in a second direction which is different from the first direction

BRIEF DESCRIPTION OF THE DRAWINGS

The above and other aspects and features of the present inventive concept will become more apparent by describing in detail exemplary embodiments thereof with reference to the attached drawings, in which.

DETAILED DESCRIPTION OF THE INVENTIVE CONCEPT

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will filly convey the scope of the invention to those skilled in the art. The same reference numbers indicate the same components throughout the specification. In the attached figures, the thickness of layers and regions is exaggerated for clarity.

It will also be understood that when a layer is referred to as being "on" another layer or substrate, it can be directly on the other layer or substrate, or intervening layers may also be present. In contrast, when an element is referred to as being "directly on" another element, there are no intervening elements present.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Unless defined otherwise, all technical and scientific terms used herein have the same meaning as commonly understood by one of ordinary skill in the art to which this invention belongs. It is noted that the use of any and all examples, or exemplary terms provided herein is intended merely to better illuminate the invention and is not a limitation on the scope of the invention unless otherwise specified. Further, unless defined otherwise, all terms defined in generally used dictionaries may not be overly interpreted.

Figure 23:
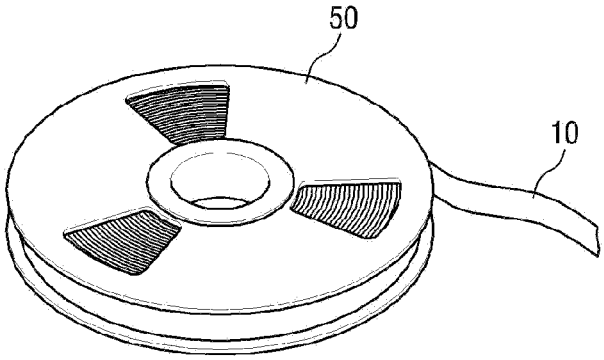
FIG. 23 is a perspective view of a source reel 50 used in the embodiment of FIG. 1.
Figure 24:
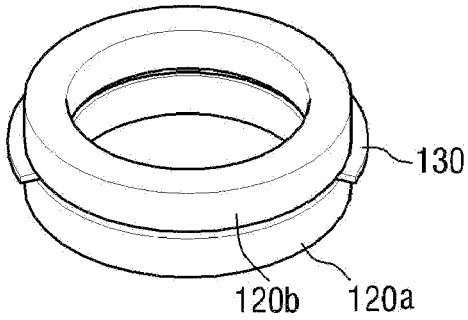
FIG. 24 is a perspective view of a bobbin used in the embodiment of FIG. 1.
Figure 25:
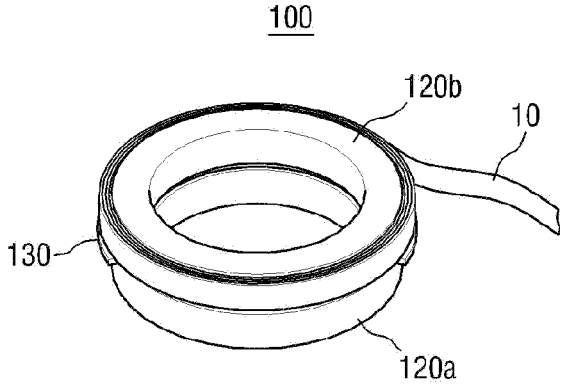
FIG. 25 is a view of a superconducting wire 10 wounded around the bobbin of FIG. 24.

FIGS. 1 through 10 are diagrams illustrating intermediate processes included in a winding method according to an embodiment of the present inventive concept. FIG. 23 is a perspective view of a source reel 50 used in the embodiment of FIG. 1. FIG. 24 is a perspective view of a bobbin used in the embodiment of FIG. 1. FIG. 25 is a view of a superconducting wire 10 wounded around the bobbin of FIG. 24.

Figure 1:
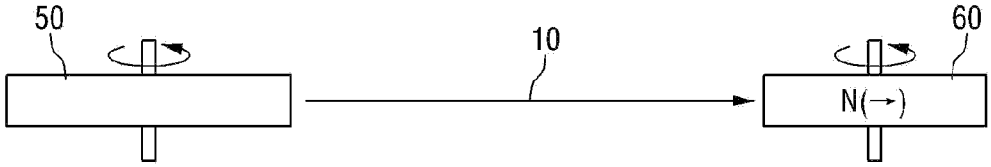
FIGS. 1 through 10 are diagrams illustrating intermediate processes included in a winding method according to an embodiment of the present inventive concept.

Referring to FIGS. 1 and 23, the superconducting wire 10 is wound from the source reel 50 onto an auxiliary reel 60 a first number of times (N) in a first direction (e.g., a forward direction).

Specifically, the superconducting wire 10 is wound around the source reel 50. The auxiliary reel 60 may have substantially the same shape as the source reel 50. Initially, the superconducting wire 10 may not be wound around the auxiliary reel 60. Each of the source reel 50 and the auxiliary reel 60 may have a cylindrical shape and include a through hole therein. As shown in the drawings, as the source reel 50 rotates, the superconducting wire 10 unwinds from the source reel 50 to be wound around the auxiliary reel 60.

The superconducting wire 10 may include at least one of a Bi—Sr—Ca—Cr—O (BACCO)-based wire and a coated conductor (CC)-based wire.

In the drawings, winding the superconducting wire 10 in the first direction (the forward direction) is illustrated as winding the superconducting wire 10 in a right direction (→). However, the present inventive concept is not limited thereto.

Figure 2:
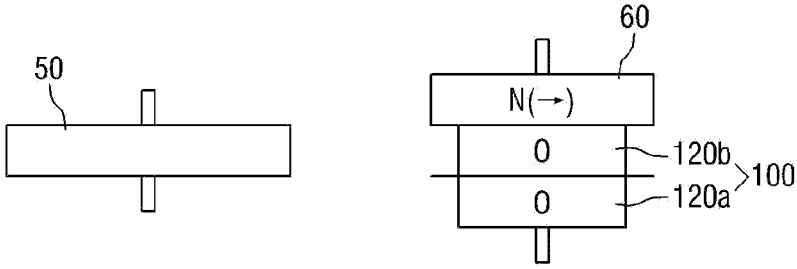

Referring to FIGS. 2 and 24, the auxiliary reel 60 and a first bobbin 100 are fixed to each other.

As shown in the drawings, the first bobbin 100 may be fixed to under the auxiliary reel 60.

The first bobbin 100 is an object on which the superconducting wire 10 is wound. The first bobbin 100 may have a cylindrical shape. In addition, the first bobbin 100 may have a through hole therein. The first bobbin 100 may be made of a material that is unaffected by a magnetic field. Examples of the material include glass fiber reinforced plastic (GFRP), Bakelite, and insulated aluminum.

The first bobbin 100 may include a first lane 120*a* and a second lane 120*b*. The first lane 120*a* and the second lane 120*b* may be, but are not limited to, a lower lane and an upper lane, respectively. The first lane 120*a* and the second lane 120*b* may be separated from each other by a spacer 130.

The spacer 130 guides the superconducting wire 10 when the superconducting wire 10 is wound around the first bobbin 100. The spacer 130 may have a fan-shaped outer circumferential surface. The spacer 130 may be placed at regular intervals on an outer circumferential surface of the first bobbin 100.

When the first bobbin 100 is fixed to the auxiliary reel 60, it may not have the superconducting wire 10 wound therearound. That is, the superconducting wire 10 may not yet be wound around the first lane 120*a* and the second lane 120*b*.

The auxiliary reel 60 and the first bobbin 100 may be fixed to each other by, but not limited to, bolts and nuts.

When the auxiliary reel 60 and the first bobbin 100 are fixed to each other, the source reel 50 and the auxiliary reel 60 are still connected by the superconducting wire 10.

Figure 3:
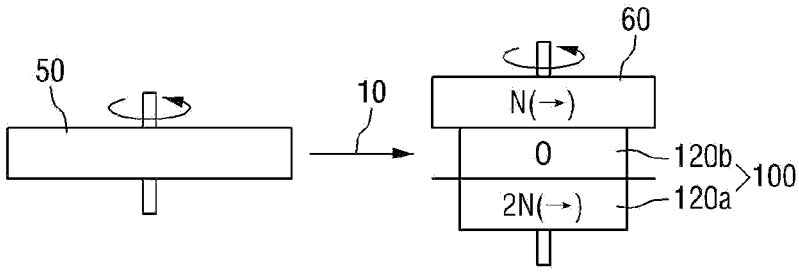

Referring to FIGS. 3 and 25, the superconducting wire 10 is wound from the source reel 50 onto the first lane 120*a* of the first bobbin 100 a second number of times (2N) in the first direction (e.g., the forward direction).

Consequently, the superconducting wire 10 unwound from the source reel 50 is wound around the auxiliary reel 60 the first number of times (N) and wound around the first lane 120*a* of the first bobbin 100 the second number of times (2N). That is, the superconducting wire 10 is wound from the source reel 50 onto the auxiliary reel 60 and the first bobbin 100 without being broken.

Figure 4:
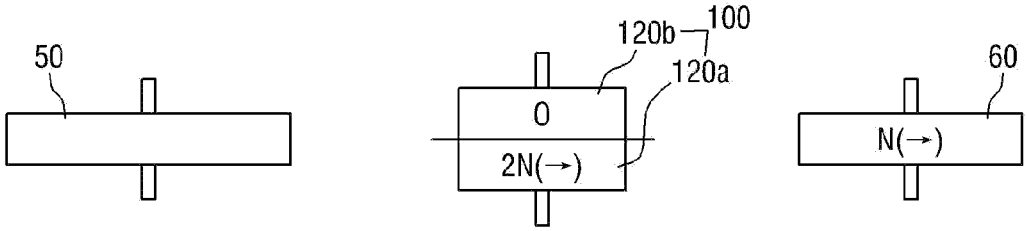

Referring to FIG. 4, the auxiliary reel 60 and the first bobbin 100 are separated from each other.

Figure 5:
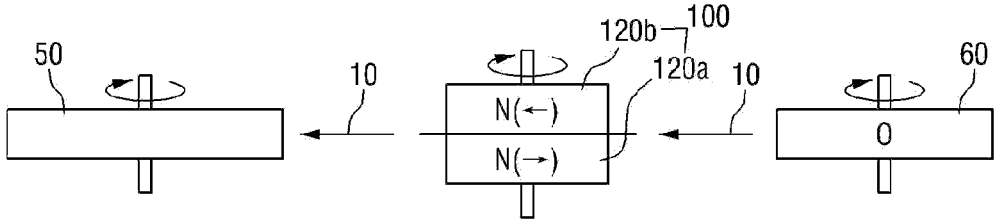

Referring to FIG. 5, while the superconducting wire 10 is wound from the auxiliary reel 60 onto the second lane 120*b* of the first bobbin 100 a third number of times (N) in a second direction (e.g., a reverse direction) which is different from the first direction (the forward direction), it is wound from the first lane 120*a* of the first bobbin 100 onto the source reel 50 the third number of times (N) in the second direction (the reverse direction).

Specifically, the source reel 50, the auxiliary reel 60 and the first bobbin 100 are connected to each other by the superconducting wire 10. Therefore, when the source reel 50 rotates in the second direction (the reverse direction), the auxiliary reel 60 and the first bobbin 100 also rotate in the second direction. As a result, the superconducting wire 10 is wound from the first lane 120*a* of the first bobbin 100 onto the source reel 50 and wound from the auxiliary reel 60 onto the second lane 120*b* of the first bobbin 100. That is, the superconducting wire 10 unwinds from the first lane 120*a* of the first bobbin 100 to be wound around the source reel 50 and unwinds from the auxiliary reel 60 to be wound around the second lane 120*b* of the first bobbin 100.

Consequently, the superconducting wire 10 is wound around the first lane 120*a* of the first bobbin 100 a number of times obtained by subtracting the third number of times (N) from the second number of times (2N) (i.e., 2N−N=N). In addition, the superconducting wire 10 is wound around the second lane 120*b* of the first bobbin 100 the third number of times (N).

In the drawings, winding the superconducting wire 10 in the second direction (the reverse direction) is illustrated as winding the superconducting wire 10 in a left direction (←). However, the present inventive concept is not limited thereto.

In the processes of FIGS. 1 and 5, the second number of times (2N) may be, but is not limited to, twice the first number of times (N). In addition, the third number of times (N) may be, but is not limited to, equal to the first number of times (N). If the second number of times (2N) is twice the first number of times (N) and if the first number of times (N) is equal to the third number of times (N), the superconducting wire 10 may be wound around the first lane 120*a* of the first bobbin 100 N times in the forward direction and wound round the second lane 120*b* of the first bobbin 100 N times in the reverse direction.

Figure 6:
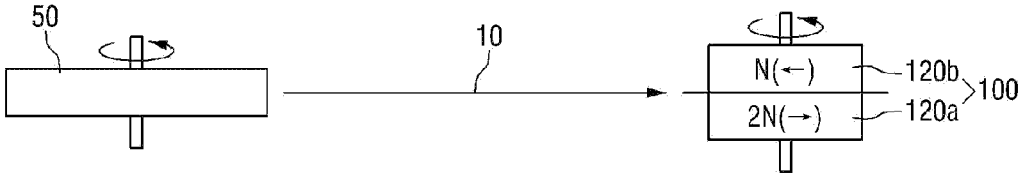

Referring to FIG. 6, the superconducting wire 10 is wound from the source reel 50 onto the first lane 120*a* of the first bobbin 100 the first number of times (N) in the first direction (e.g., the forward direction).

Therefore, the superconducting wire 10 is wound around the first lane 120*a* of the first bobbin 100 2N times (=N times+N times) in the forward direction.

Figure 7:
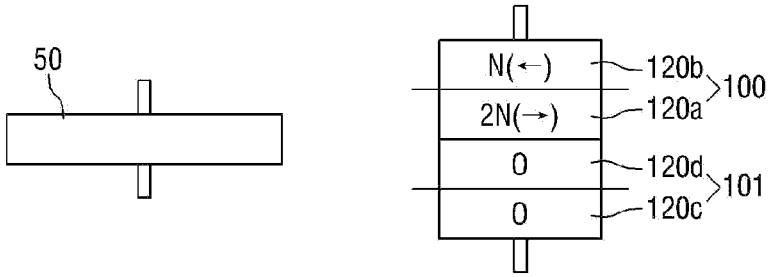

Referring to FIG. 7, the first bobbin 100 and a second bobbin 101 are fixed to each other.

Specifically, the second bobbin 101 may have substantially the same configuration as the first bobbin 100. That is, the second bobbin 101 may include a third lane 120*c* and a fourth lane 120*d*. The third lane 120*c* and the fourth lane 120*d* may be, but are not limited to, a lower lane and an upper lane, respectively. The third lane 120*c* and the fourth lane 120*d* may be separated from each other by a spacer 130.

As shown in the drawings, the second bobbin 101 may be fixed to under the first bobbin 100. When the first bobbin 100 and the second bobbin 101 are fixed to each other, the second bobbin 101 may not have the superconducting wire 10 wound therearound. The first bobbin 100 and the second bobbin 101 may be fixed to each other by, but not limited to, bolts and nuts.

Figure 8:
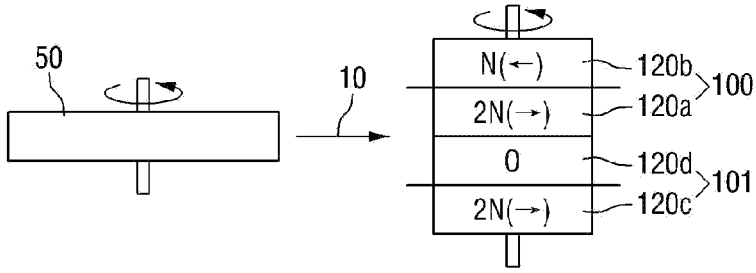

Referring to FIG. 8, the superconducting wire 10 is wound from the source reel 50 onto the second lane 120*c* of the second bobbin 101 the second number of times (2N) in the first direction.

Consequently, the superconducting wire 10 unwound from the source reel 50 is wound around the first lane 120*a* of the first bobbin 100 2N times in the forward direction, wound around the second lane 120*b* of the first bobbin 100 N times in the reverse direction, and wound around the third lane 120*c* of the second bobbin 101 the second number of times (2N) in the forward direction. That is, the superconducting wire 10 is wound from the source reel 50 onto the first bobbin 100 and the second bobbin 101 without being broken.

Figure 9:
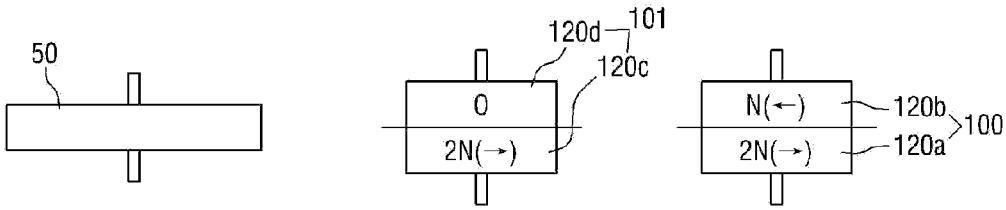

Referring to FIG. 9, the first bobbin 100 and the second bobbin 101 are separated from each other.

Figure 10:
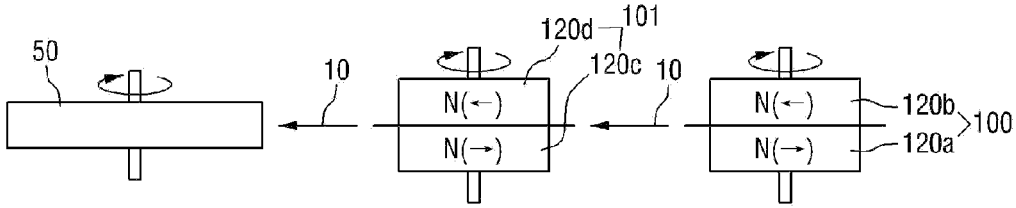

Referring to FIG. 10, while the superconducting wire 10 is wound from the first lane 120*a* of the first bobbin 100 onto the fourth lane 120*d* of the second bobbin 101 the third number of times (N) in the second direction (e.g., the reverse direction) which is different from the first direction (the forward direction), it is wound from the third lane 120*c* of the second bobbin 101 onto the source reel 50 the third number of times (N) in the second direction.

Specifically, the source reel 50, the first bobbin 100 and the second bobbin 101 are connected to each other by the superconducting wire 10. Therefore, when the source reel 50 rotates in the second direction, the first bobbin 100 and the second bobbin 101 also rotate in the second direction. As a result, the superconducting wire 10 is wound from the third lane 120*c* of the second bobbin 101 onto the source reel 50 and wound from the first lane 120*a* of the first bobbin 100 onto the fourth lane 120*d* of the second bobbin 101. That is, the superconducting wire 10 unwinds from the third lane 120*c* of the second bobbin 101 to be wound around the source reel 50 and unwinds from the first lane 120*a* of the first bobbin 100 to be wound around the fourth lane 120*d* of the second bobbin 101.

Consequently, the superconducting wire 10 is wound around the third lane 120*c* of the second bobbin 101*a* number of times obtained by subtracting the third number of times (N) from the second number of times (2N) (i.e., 2N−N=N). In addition, the superconducting wire 10 is wound around the fourth lane 120*d* of the second bobbin 101 the third number of times (N).

In the winding method according to the current embodiment, the superconducting wire 10 can be wound around a number of bobbins 100 and 101 without being cut. That is, there is no need to bond cut parts of the superconducting wire 10. Therefore, unnecessary resistance components that may be created at bonded parts can be minimized.

Figure 11:
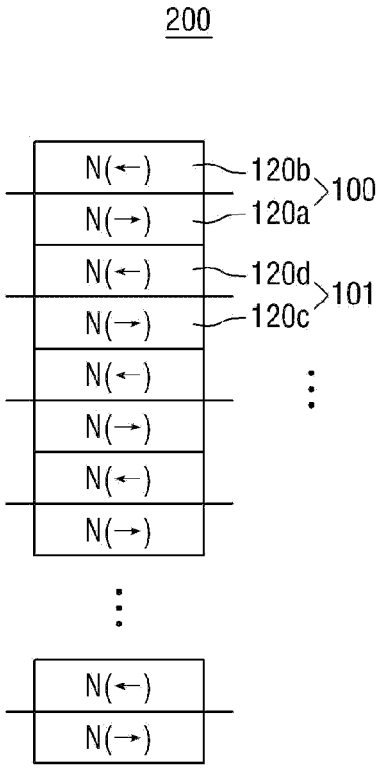
FIG. 11 is a view of a magnet fabricated using the winding method according to the embodiment of FIGS. 1 through 10.
Figure 26:
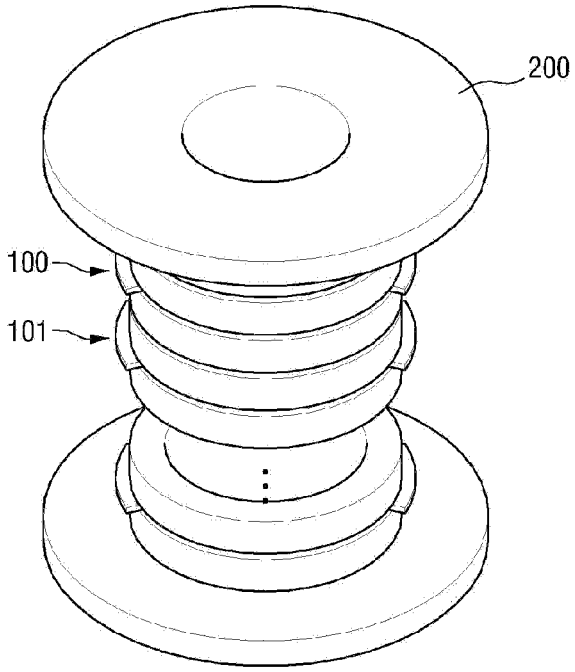
FIG. 26 is a perspective view of a stack of bobbins in the magnet 200 of FIG. 11.
Figure 27:
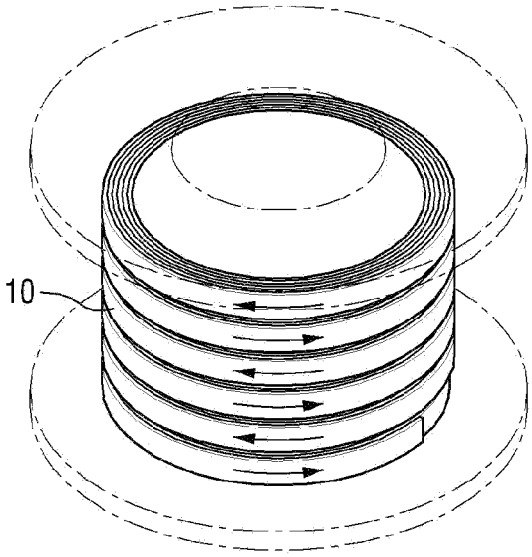
FIG. 27 is a perspective view of a superconducting wire 10 wound around the magnet 200 of FIG. 11.

FIG. 11 is a view of a magnet 200 fabricated using the winding method according to the embodiment of FIGS. 1 through 10. That is, after the processes of FIGS. 1 through 10, the processes of FIGS. 6 through 10 are repeated to complete the magnet 200. FIG. 26 is a perspective view of a stack of bobbins in the magnet 200 of FIG. 11. FIG. 27 is a perspective view of a superconducting wire 10 wound around the magnet 200 of FIG. 11.

Referring to FIGS. 11 and 26, the magnet 200 according to the current embodiment includes a stack of a plurality of bobbins 100 and 101 and the superconducting wire 10. Each of the bobbins 100 and 101 may include two lanes 120*a* and 120*b* or 120*c* and 120*d*. For example, the first bobbin 100 may include the first lane 120*a* and the second lane 120*b*, and the second bobbin 101 may include the third lane 120*c* and the fourth lane 120*d*. The second bobbin 101 may contact the first bobbin 100 (for example, contact a bottom surface of the first bobbin 100) and may be fixed to the first bobbin 100.

Referring to FIGS. 11 and 27, the superconducting wire 10 may be wound around each lane 120*a*, 120*b*, 120*c* or 120*d* of each of the bobbins 100 and 101. In particular, the superconducting wire 10 may be continuous although wound around each lane 120*a*, 120*b*, 120*c* or 120*d* of each of the bobbins 100 and 101. When the superconducting wire 10 is continuous, it denotes that the superconducting wire 10 is wound around the different bobbins 100 and 101 without being broken. That is, when the superconducting wire 10 is continuous, it may not have bonded parts.

Referring to FIG. 11, the superconducting wire 10 may be wound around each lane an equal number of times (N times). In addition, the superconducting wire 10 may be wound N times in a forward direction (→) and N times in a reverse direction (←) in an alternating manner from top to bottom. Specifically, the superconducting wire 10 may be wound around the first lane 120*a* of the first bobbin 100 and the third lane 120*c* of the second bobbin 101 N times in a first direction (the forward direction) and may be wound around the second lane 120*b* of the first bobbin 100 and the fourth lane 120*d* of the second bobbin 101 in a second direction (the reverse direction) which is different from the first direction.

The bobbins 100 and 100 may be fixed to each other by, but not limited to, bolts and nuts.

FIGS. 12 through 21 are diagrams illustrating intermediate processes included in a winding method according to another embodiment of the present inventive concept. For simplicity, the following description will focus on differences from the previous embodiment described above with reference to FIGS. 1 through 10.

Figure 12:
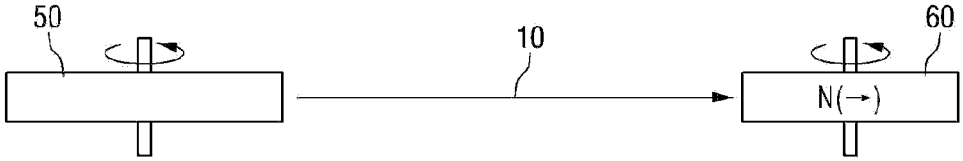
FIGS. 12 through 21 are diagrams illustrating intermediate processes included in a winding method according to another embodiment of the present inventive concept.

Referring to FIG. 12, a superconducting wire 10 is wound from a source reel 50 onto an auxiliary reel 60 a first number of times (N) in a first direction (e.g., a forward direction).

Figure 13:
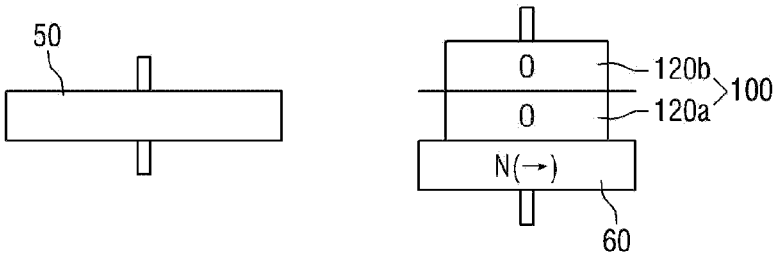

Referring to FIG. 13, the auxiliary reel 60 and a first bobbin 100 are fixed to each other.

As shown in the drawing, the first bobbin 100 may be fixed onto the auxiliary reel 60.

When the auxiliary reel 60 and the first bobbin 100 are fixed to each other, they are still connected by the superconducting wire 10.

Figure 14:
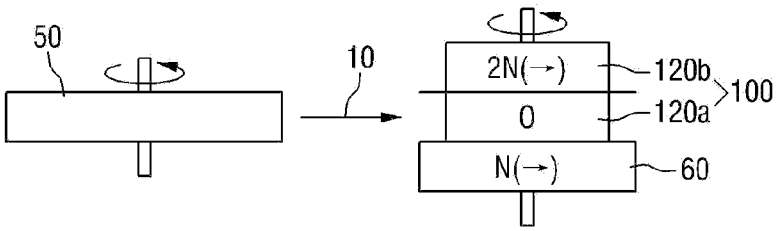

Referring to FIG. 14, the superconducting wire 10 is wound from the source reel 50 onto a second lane 120*b* of the first bobbin 100 a second number of times (2N) in the first direction (e.g., the forward direction).

Consequently, the superconducting wire 10 unwound from the source reel 50 is wound around the auxiliary reel 60 the first number of times (N) and wound around the second lane 120*b* of the first bobbin 100 the second number of times (2N). That is, the superconducting wire 10 is wound from the source reel 50 onto the auxiliary reel 60 and the first bobbin 100 without being broken.

Figure 15:
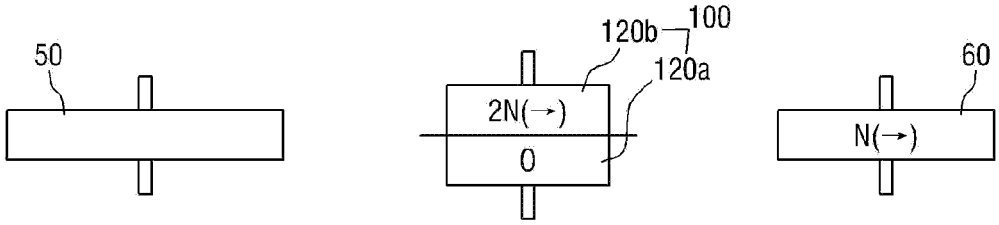

Referring to FIG. 15, the auxiliary reel 60 and the first bobbin 100 are separated from each other.

Figure 16:
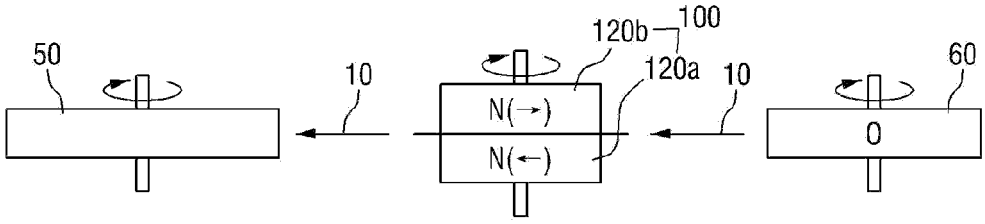

Referring to FIG. 16, while the superconducting wire 10 is wound from the auxiliary reel 60 onto a first lane 120*a* of the first bobbin 100 a third number of times (N) in a second direction (e.g., a reverse direction) which is different from the first direction, it is wound from the second lane 120*b* of the first bobbin 100 onto the source reel 50 the third number of times (N) in the second direction (the reverse direction).

Specifically, the source reel 50, the auxiliary reel 60 and the first bobbin 100 are connected to each other by the superconducting wire 10. Therefore, when the source reel 50 rotates in the second direction, the auxiliary reel 60 and the first bobbin 100 also rotate in the second direction. As a result, the superconducting wire 10 is wound from the second lane 120*b* of the first bobbin 100 onto the source reel 50 and wound from the auxiliary reel 60 onto the first lane 120*a* of the first bobbin 100. That is, the superconducting wire 10 unwinds from the second lane 120*b* of the first bobbin 100 to be wound around the source reel 50 and unwinds from the auxiliary reel 60 to be wound around the first lane 120*a* of the first bobbin 100.

Consequently, the superconducting wire 10 is wound around the second lane 120*b* of the first bobbin 100 a number of times obtained by subtracting the third number of times (N) from the second number of times (2N) (i.e., 2N−N=N). In addition, the superconducting wire 10 is wound around the first lane 120*a* of the first bobbin 100 the third number of times (N).

Figure 17:
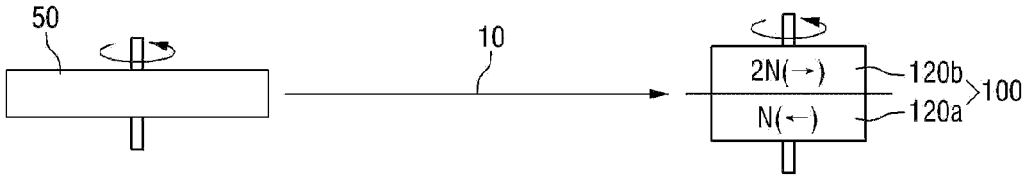

Referring to FIG. 17, the superconducting wire 10 is wound from the source reel 50 onto the second lane 120*b* of the first bobbin 100 the first number of times (N) in the first direction (e.g., the forward direction).

Therefore, the superconducting wire 10 is wound around the second lane 120*b* of the first bobbin 100 2N times (=N times+N times) in the forward direction.

Figure 18:
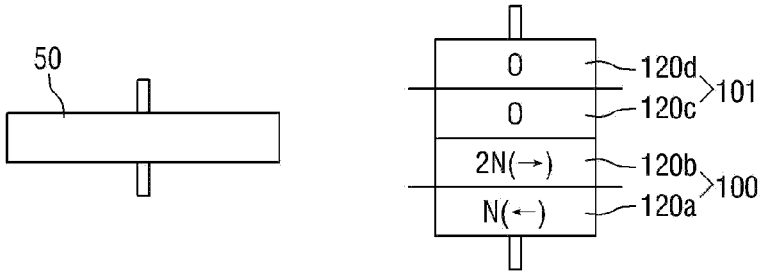

Referring to FIG. 18, the first bobbin 100 and a second bobbin 101 are fixed to each other.

Specifically, the second bobbin 101 may be fixed onto the first bobbin 100.

Figure 19:
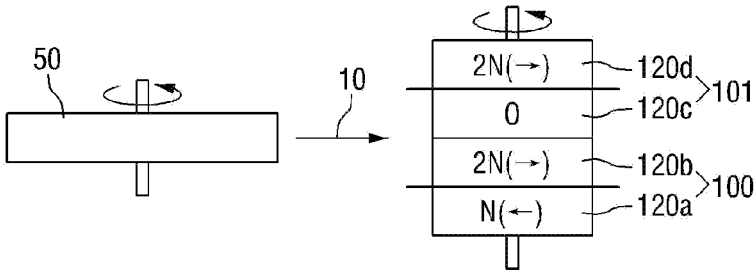

Referring to FIG. 19, the superconducting wire 10 is wound from the source reel 50 onto a fourth lane 120*d* of the second bobbin 101 the second number of times (2N) in the first direction.

Consequently, the superconducting wire 10 unwound from the source reel 50 is wound around the second lane 120*b* of the first bobbin 100 2N times in the forward direction, wound around the first lane 120*a* of the first bobbin 100 N times in the reverse direction, and wound around the fourth lane 120*d* of the second bobbin 101 the second number of times (2N) in the forward direction. That is, the superconducting wire 10 is wound from the source reel 50 onto the first bobbin 100 and the second bobbin 101 without being broken.

Figure 20:
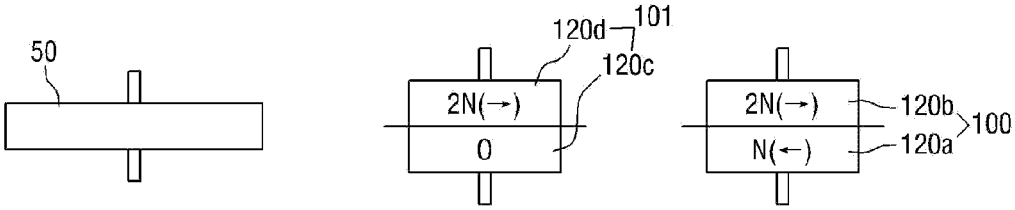

Referring to FIG. 20, the first bobbin 100 and the second bobbin 101 are separated from each other.

Figure 21:
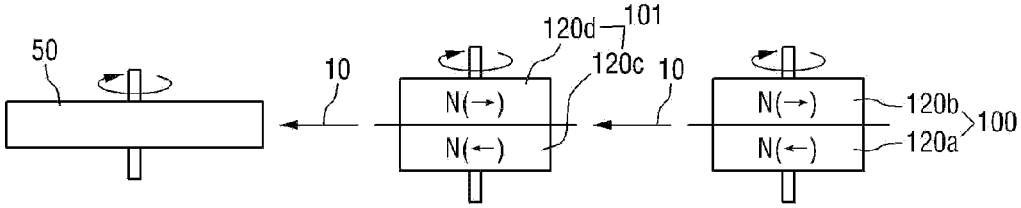

Referring to FIG. 21, while the superconducting wire 10 is wound from the second lane 120*b* of the first bobbin 100 onto a third lane 120*c* of the second bobbin 101 the third number of times (N) in the second direction which is different from the first direction, it is wound from the fourth lane 120*d* of the second bobbin 101 onto the source reel 50 the third number of times (N) in the second direction.

Specifically, the source reel 50, the first bobbin 100 and the second bobbin 101 are connected to each other by the superconducting wire 10. Therefore, when the source reel 50 rotates in the second direction, the first bobbin 100 and the second bobbin 101 also rotate in the second direction. As a result, the superconducting wire 10 is wound from the fourth lane 120*d* of the second bobbin 101 onto the source reel 50 and wound from the second lane 120*b* of the first bobbin 100 onto the third lane 120*c* of the second bobbin 101. That is, the superconducting wire 10 unwinds from the fourth lane 120*d* of the second bobbin 101 to be wound around the source reel 50 and unwinds from the second lane 120*b* of the first bobbin 100 to be wound around the third lane 120*c* of the second bobbin 101.

Consequently, the superconducting wire 10 is wound around the fourth lane 120*d* of the second bobbin 101 a number of times obtained by subtracting the third number of times (N) from the second number of times (2N) (i.e., 2N−N=N). In addition, the superconducting wire 10 is wound around the third lane 120*c* of the second bobbin 101 the third number of times (N).

Figure 22:
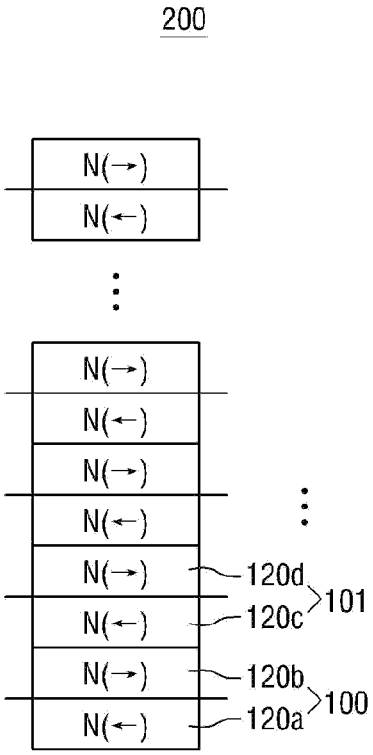
FIG. 22 is a view of a magnet fabricated using the winding method according to the embodiment of FIGS. 12 through 21.

FIG. 22 is a view of a magnet 200 fabricated using the winding method according to the embodiment of FIGS. 12 through 21.

Referring to FIG. 22, a superconducting wire 10 may be wound N times in a reverse direction (←) and N times in a forward direction (→) in an alternating manner from bottom to top. Specifically, the superconducting wire 10 may be wound around a first lane 120*a* of a first bobbin 100 and a third lane 120*c* of a second bobbin 101 N times in a second direction which is different from a first direction and may be wound around a second lane 120*b* of the first bobbin 100 and a fourth lane 120*d* of the second bobbin 101 in a first direction (the forward direction).

In concluding the detailed description, those skilled in the art will appreciate that many variations and modifications can be made to the preferred embodiments without substantially departing from the principles of the present invention. Therefore, the disclosed preferred embodiments of the invention are used in a generic and descriptive sense only and not for purposes of limitation.

What is claimed is:

1. A winding method comprising:

providing a source reel which has a superconducting wire wound therearound, a first bobbin which comprises a first lane and a second lane, and a second bobbin which comprises a third lane and a fourth lane;

winding the superconducting wire from the source reel onto the first lane of the first bobbin a first number of times in a first direction;

fixing the first bobbin and the second bobbin to each other;

winding the superconducting wire from the source reel onto the third lane of the second bobbin a second number of times in the first direction;

separating the first bobbin and the second bobbin from each other; and winding the superconducting wire from the first lane of the first bobbin onto the fourth lane of the second bobbin a third number of times in a second direction which is different from the first direction while winding the superconducting wire from the third lane of the second bobbin onto the source reel the third number of times in the second direction.

2. The winding method of claim 1, wherein the first number of times is equal to the third number of times.

3. The winding method of claim 2, wherein the second number of times is twice the first number of times.

4. The winding method of claim 1, wherein the first and second lanes of the first bobbin are lower and upper lanes, respectively, and the third and fourth lanes of the second bobbin are lower and upper lanes, respectively.

5. The winding method of claim 4, wherein in the fixing of the first bobbin and the second bobbin to each other, the second bobbin is fixed to under the first bobbin.

6. The winding method of claim 1, wherein the first and second lanes of the first bobbin are upper and lower lanes, respectively, and the third and fourth lanes of the second bobbin are upper and lower lanes, respectively.

7. The winding method of claim 6, wherein in the fixing of the first bobbin and the second bobbin to each other, the second bobbin is fixed onto the first bobbin.

8. The winding method of claim 1, wherein the superconducting wire wound around the source reel, the first bobbin and the second bobbin is continuous.

9. The winding method of claim 1, further comprising:

winding the superconducting wire from the source reel onto an auxiliary reel the first number of times in the first direction;

fixing the auxiliary reel and the first bobbin to each other;

winding the superconducting wire from the source reel onto the first lane of the first bobbin the second number of times in the first direction;

separating the auxiliary reel and the first bobbin from each other;

winding the superconducting wire from the auxiliary reel onto the second lane of the first bobbin the third number of times in the second direction which is different from the first direction while winding the superconducting wire from the first lane of the first bobbin onto the source reel the third number of times in the second direction.

10. The winding method of claim 9, wherein the first number of times is equal to the third number of times.

11. The winding method of claim 10, wherein the second number of times is twice the first number of times.

12. A winding method comprising:

providing a source reel, a first bobbin which comprises a first lane and a second lane, and a second bobbin which comprises a third lane and a fourth lane;

winding a superconducting wire around the first lane a second number of times in a first direction, around the second lane a first number of times in a second direction, and around the third lane the second number of times in the first direction; and winding the superconducting wire from the first lane of the first bobbin onto the fourth lane of the second bobbin the first number of times in the second direction while winding the superconducting wire from the third lane of the second bobbin onto the source reel the first number of times in the second direction, wherein the first direction and the second direction are different, and the superconducting wire is continuous.

13. The winding method of claim 12, wherein the second number of times is twice the first number of times.

14. A magnet comprising:

a first bobbin comprising a first lane and a second lane;

a second bobbin comprising a third lane and a fourth lane and fixed to the first bobbin to contact the first bobbin; and a superconducting wire wound around the first through fourth lanes, wherein the superconducting wire is continuous, wound around the first lane and the third lane in a first direction and wound around the second lane and the fourth lane in a second direction which is different from the first direction.

15. The magnet of claim 14, wherein the first and second lanes of the first bobbin are lower and upper lanes, respectively, and the third and fourth lanes of the second bobbin are lower and upper lanes, respectively.

16. The magnet of claim 15, wherein the first bobbin further comprises a first spacer interposed between the first lane and the second lane, and the second bobbin further comprises a second spacer interposed between the third lane and the fourth lane.

17. The magnet of claim 14, wherein the superconducting wire is wound around each of the first through fourth lanes an equal number of times.

18. The magnet of claim 14, wherein the first bobbin and the second bobbin are fixed to each other by bolts and nuts.

* * * * *